US008938363B2

(12) United States Patent
Beasley et al.

(10) Patent No.: US 8,938,363 B2
(45) **Date of Patent: *Jan. 20, 2015**

(54) ACTIVE SEISMIC MONITORING OF FRACTURING OPERATIONS AND DETERMINING CHARACTERISTICS OF A SUBTERRANEAN BODY USING PRESSURE DATA AND SEISMIC DATA

(75) Inventors: Craig J. Beasley, Houston, TX (US); Iain Bush, East Horsley (GB)

(73) Assignee: WesternGeco L.L.C., Houston, TX (US)

( * ) Notice: Subject to any disclaimer, the term of this patent is extended or adjusted under 35 U.S.C. 154(b) by 621 days.

This patent is subject to a terminal disclaimer.

(21) Appl. No.: 13/112,834

(22) Filed: May 20, 2011

(65) Prior Publication Data

US 2011/0272147 A1 Nov. 10, 2011

Related U.S. Application Data

(63) Continuation-in-part of application No. 12/256,285, filed on Oct. 22, 2008, now Pat. No. 7,967,069, and a continuation-in-part of application No. 12/193,278, filed on Aug. 18, 2008.

(51) Int. Cl.

| | |
|---|---|
| ***G01V 1/40*** | (2006.01) |
| ***E21B 43/26*** | (2006.01) |
| ***E21B 47/06*** | (2012.01) |
| ***E21B 47/10*** | (2012.01) |
| ***E21B 49/00*** | (2006.01) |

(52) U.S. Cl.

CPC ..... *E21B 47/06* (2013.01); *E21B 43/26* (2013.01); *E21B 47/101* (2013.01); *E21B 49/008* (2013.01)

USPC ..... 702/11; 166/308.1

(58) Field of Classification Search

USPC ..... 702/11, 1–2, 6–7, 9, 12–14, 18, 127, 702/138, 182–183, 189; 324/323–324, 332, 324/334–335, 337, 344–345, 347–348, 324/353; 166/250.01, 250.1, 251.1, 252.1, 166/256–257, 259, 261, 266, 268, 271, 166/272.6, 308.1–308.2, 312

See application file for complete search history.

(56) References Cited

U.S. PATENT DOCUMENTS

| | | | |
|---|---|---|---|
| 4,280,200 | A | 7/1981 | Silverman |
| 5,010,527 | A | 4/1991 | Mahrer |
| 5,128,866 | A | 7/1992 | Weakley |

(Continued)

OTHER PUBLICATIONS

D. Wynn, Geophysical Monitoring of Geologic Sequestration in Aquifers and Depleted Oil and Gas Fields, Aug. 2003, MS Project Report, Department of Geophysics, Stanford University, 43 pages.*

(Continued)

*Primary Examiner* — Toan Le
(74) *Attorney, Agent, or Firm* — Gary Gex

(57) ABSTRACT

A method for managing a fracturing operation. In one implementation, the method may include positioning one or more sources and one or more receivers near a hydrocarbon reservoir; pumping a fracturing fluid into a well bore of the hydrocarbon reservoir; performing a survey with the sources and the receivers during the fracturing operation; comparing the baseline survey to the survey performed during the fracturing operation; analyzing one or more differences between the baseline survey and the survey performed during the fracturing operation; and modifying the fracturing operation based on the differences.

23 Claims, 7 Drawing Sheets

(56) References Cited

U.S. PATENT DOCUMENTS

| | | | | |
|---|---|---|---|---|
| 5,574,218 | A | 11/1996 | Withers | |
| 5,899,272 | A | 5/1999 | Loree | |
| 5,924,049 | A | 7/1999 | Beasley et al. | |
| 6,112,817 | A | 9/2000 | Voll et al. | |
| 6,206,108 | B1 | 3/2001 | MacDonald et al. | |
| 6,263,283 | B1 | 7/2001 | Snider et al. | |
| 6,412,561 | B1 | 7/2002 | Brown et al. | |
| 6,473,696 | B1 | 10/2002 | Onyia et al. | |
| 7,003,439 | B2 | 2/2006 | Aldred et al. | |
| 7,063,174 | B2 | 6/2006 | Chemali et al. | |
| 7,127,353 | B2 | 10/2006 | Geiser | |
| 7,134,492 | B2 | 11/2006 | Willberg et al. | |
| 7,255,173 | B2 | 8/2007 | Hosie et al. | |
| 7,274,304 | B2 | 9/2007 | Hall et al. | |
| 7,280,918 | B2 | 10/2007 | Williams | |
| 7,389,185 | B2 | 6/2008 | Craig | |
| 7,916,576 | B2 | 3/2011 | Beasley et al. | |
| 7,967,069 | B2 * | 6/2011 | Beasley | 166/308.1 |
| 8,210,262 | B2 * | 7/2012 | Beasley | 166/308.1 |
| 2004/0035634 | A1 | 2/2004 | Rueter | |
| 2005/0235745 | A1 | 10/2005 | Proett et al. | |
| 2006/0023567 | A1 | 2/2006 | Uhl et al. | |
| 2006/0047431 | A1 | 3/2006 | Geiser | |
| 2006/0062084 | A1 | 3/2006 | Drew | |
| 2006/0081412 | A1 | 4/2006 | Wright et al. | |
| 2006/0247861 | A1 | 11/2006 | McCoy et al. | |
| 2007/0204995 | A1 | 9/2007 | Hofman et al. | |
| 2008/0149329 | A1 | 6/2008 | Cooper et al. | |
| 2008/0316860 | A1 | 12/2008 | Muyzert et al. | |
| 2009/0168600 | A1 | 7/2009 | Moore et al. | |
| 2009/0242205 | A1 | 10/2009 | Coste et al. | |
| 2009/0248309 | A1 | 10/2009 | Neville et al. | |
| 2010/0032156 | A1 | 2/2010 | Petty et al. | |
| 2010/0042325 | A1 | 2/2010 | Beasley et al. | |
| 2010/0096125 | A1 | 4/2010 | Beasley | |
| 2011/0199862 | A1 | 8/2011 | Pop | |
| 2011/0214869 | A1 | 9/2011 | Beasley | |
| 2013/0000893 | A1 * | 1/2013 | Beasley et al. | 166/250.1 |
| 2014/0027111 | A1 | 1/2014 | Beasley et al. | |

OTHER PUBLICATIONS

USPTO Office Action (Jun. 30, 2011), Response/Amendment (Apr. 13, 2011), and Office Action (Dec. 23, 2010); U.S. Appl. No. 12/193,278 (US 2010-0042325 A1—Beasley, et al.).

USPTO Office Action (Sep. 2, 2011); U.S. Appl. No. 13/112,780 (Beasley).

USPTO Allowance (Feb. 22, 2011), Response/Amendment after Final (Feb. 9, 2011), Final Action (Dec. 9, 2010), Response/Amendment (Sep. 21, 2010), and Office Action (Jun. 24, 2010); U.S. Appl. No. 12/256,285 (US 7,967,069—Beasley).

EPO Search Report and Opinion (Jul. 12, 2011); EP Serial No. 09173773.4 (EP 2 180 140—Geco Technology B.V.).

Wills, et al.; Active and Passive Imaging of Hydraulic Fractures; Geophysics: The Leading Edge of Exploration; vol. 7, No. 11; pp. 15-22; Jul. 1992.

PCT International Preliminary Report on Patentability for PCT / US2009 / 052706; issued Feb. 22, 2011.

PCT International Search Report for PCT / US2009 / 052706; issued Mar. 16, 2010.

R. Elmar; Fluid Induced Microseismicity: Data Modeling and Inversion of Hydraulic Properties of Rocks; PhD Thesis, Freie Universität Berlin; http://www.diss.fu-berlin.de/diss/receive/FUDISS_thesis_000000001210; 2008.

Dragoset, et al; The Impact of Field Survey Characteristics on Surface-Related Multiple Attenuation; Offshore Technology Conference Proceedings 2004.

Karpfinger, et al; Diffusivity Estimations based on Seismicity Triggered by Fluid Injections in Boreholes; Expanded Abstract Presented at the 66th EAGE Conference & Exhibition; Paris, France; Jun. 7-10, 2004.

Rothert, et al.; Short Note: Microseismic Monitoring of Borehole Fluid Injections: Data Modeling and Inversion for Hydraulic Properties of Rocks; Geophysics; vol. 68; pp. 1051-1066; 2003.

Shapiro, et al; Triggering of Seismicity by Pore Pressure Perturbations: Permeability-related Signatures of the Phenomenon; Pure and Applied Geophysics; vol. 160; pp. 1051-1066; 2003.

Shapiro, et al; Characterization of Fluid Transport Properties of Reservoirs using Induced Microseismicity; Geophysics; vol. 67; pp. 212-220; 2002.

Audigane, et al; Permeability Characterization of the Soultz and Ogachi Large-Scale Reservoir using Induced Microseismicity; Geophysics; vol. 67; pp. 204-211; 2002.

Shapiro, Serge A.; An Inversion for Fluid Transport Properties of Three-Dimensionally Heterogeneous Rocks using Induces Microseismicity; Geophysics Journal International; vol. 143; pp. 931-936; 2000.

Shapiro, et al' Reply to comment by Cornet on "Large-Scale in Situ Permeability Tensor of Rocks from Induced Microseismicity"; Geophysics Journal International; vol. 140; pp. 470-473; 2000.

F. Cornet; Comment on "Large-Scale in Situ Permeability Tensor of Rocks from Induced Microseismicity" by Shapiro, et al.; Geophysics Journal International; vol. 140; pp. 465-469; 2000.

Shapiro, et al; "Large-Scale in Situ Permeability Tensor of Rocks from Induced Microseismicity"; Geophysics Journal International; vol. 137; pp. 207-213; 1999.

Cooper, et al.; Foinaven Active Reservoir Management; The time-Lapse Signal; SEG Expanded Abstracts; 1999.

Shapiro, et al; Estimating the Permeability from Fluid-Injection Induced Seismic Emission: in Thimus J.-F; Poromechanics; pp. 301-305; 1998.

Shapiro, et al; Estimating the Crust Permeability from Fluid-Injection-Induced Seismic Emission and the DTB Site; Geophysics Journal International; vol .131; pp. F15-F18; 1997.

M.A. Biot; Theory of Propagation of Elastic Waves in a Fluid-Saturated Porous Solid. II Higher Frequency range, The Journal of the Acoustical Society of America; vol. 28, No. 2; pp. 179-191; Mar. 1956.

Extended European Search Report of European Application No. 09808588.9 dated Jun. 17, 2013: pp. 1-6.

* cited by examiner

ACTIVE SEISMIC MONITORING OF FRACTURING OPERATIONS AND DETERMINING CHARACTERISTICS OF A SUBTERRANEAN BODY USING PRESSURE DATA AND SEISMIC DATA

RELATED APPLICATIONS

This application is a continuation in part of U.S. patent application Ser. No. 12/256,285, filed Oct. 22, 2008, titled ACTIVE SEISMIC MONITORING OF FRACTURING OPERATIONS, and now U.S. Pat. No. 7,967,069.

This application is also a continuation in part of U.S. patent application Ser. No. 12/193,278, filed Aug. 18, 2008, and titled DETERMINING CHARACTERISTICS OF A SUBTERRANEAN BODY USING PRESSURE DATA AND SEISMIC DATA.

BACKGROUND

1. Field of the Invention

Implementations of various technologies described herein generally relate to methods and systems for hydraulic fracturing operations. Implementations of various technologies described herein are also directed to determining characteristics of a subterranean body using pressure data and seismic data.

2. Description of the Related Art

The following descriptions and examples are not admitted to be prior art by virtue of their inclusion within this section.

Active Seismic Monitoring of Fracturing Operations

In the recovery of hydrocarbons from subterranean formations it is common practice, particularly in formations of low permeability, to fracture the hydrocarbon-bearing formation to provide flow channels. These flow channels facilitate movement of the hydrocarbons to the well bore so that the hydrocarbons may be pumped from the well.

In such fracturing operations, a fracturing fluid is hydraulically injected into a well bore penetrating the subterranean formation and is forced against the formation strata by pressure. The formation strata or rock is forced to crack and fracture, and a proppant is placed in the fracture by movement of a viscous-fluid containing proppant into the crack in the rock. The resulting fracture, with proppant in place, provides improved flow of the recoverable fluid, i.e., oil, gas or water, into the well bore.

Fracturing fluids customarily comprise a thickened or gelled aqueous solution which has suspended therein "proppant" particles that are substantially insoluble in the fluids of the formation. Proppant particles carried by the fracturing fluid remain in the fracture created, thus propping open the fracture when the fracturing pressure is released and the well is put into production. Suitable proppant materials include sand, walnut shells, sintered bauxite, or similar materials. The "propped" fracture provides a larger flow channel to the well bore through which an increased quantity of hydrocarbons can flow, thereby increasing the production rate of a well.

A problem common to many hydraulic fracturing operations is the loss of fracturing fluid into the porous matrix of the formation. Fracturing fluid loss is a major problem. Hundreds of thousands (or even millions) of gallons of fracturing fluid must be pumped down the well bore to fracture such wells, and pumping such large quantities of fluid is very costly. The lost fluid also causes problems with the fracturing operation. For example, the undesirable loss of fluid into the formation limits the fracture size and geometry which can be created during the hydraulic fracturing pressure pumping operation.

Thus, the total volume of the fracture, or crack, is limited by the lost fluid volume that is lost into the rock, because such lost fluid is unavailable to apply volume and pressure to the rock face.

Determining Characteristics of a Subterranean Body Using Pressure Data and Seismic Data Well testing is commonly performed to measure data associated with a formation or reservoir surrounding a well. Well testing involves lowering a testing tool that includes one or more sensors into the well, with the one or more sensors taking one or more of the following measurements: pressure measurements, temperature measurements, fluid type measurements, flow quantity measurements, and so forth. Well testing can be useful for determining properties of a formation or reservoir that surrounds the well. For example, pressure testing can be performed, where formation/reservoir pressure responses to pressure transients are recorded and then interpreted to determine implied reservoir and flow characteristics. However, due to the one-dimensional aspect of pressure, pressure testing provides relatively limited data. Consequently, a detailed spatial description of characteristics of a formation or reservoir typically cannot be obtained using pressure testing by itself.

SUMMARY

Described herein are implementations of various techniques for a method for managing a fracturing operation. In one implementation, the method may include positioning one or more sources and one or more receivers near a hydrocarbon reservoir; pumping a fracturing fluid into a well bore of the hydrocarbon reservoir; performing a survey with the sources and the receivers during the fracturing operation; comparing the baseline survey to the survey performed during the fracturing operation; analyzing one or more differences between the baseline survey and the survey performed during the fracturing operation; and modifying the fracturing operation based on the differences.

In another implementation, the method may also include identifying locations of the fracturing fluid within subsurface formations in which the hydrocarbon reservoir is located based on the survey. In yet another implementation, the method may include modifying the fracturing operation based on the identified locations of the fracturing fluid. In yet another implementation, the method may include modifying the positioning of the sources, the receivers or combinations thereof based on the differences. In yet another implementation, the method may include generating a survey design based on the differences.

In yet another implementation, the sources may include a weight dropping system, an accelerated weight dropping system, portable sources or combinations thereof. In yet another implementation, the sources may include one or more vibrations from a drilling operation or a fracturing operation. In yet another implementation, the sources are located on a surface, in a borehole, in a fracture or combinations thereof.

In yet another implementation, the receivers are permanently installed receivers. In yet another implementation, the receivers are located on a surface, in a borehole, in a fracture or combinations thereof.

In yet another implementation, the sources are electromagnetic sources and the receivers are electromagnetic receivers. In yet another implementation, the sources are seismic sources and the receivers are seismic receivers.

In yet another implementation, the baseline survey or the survey performed during the fracturing operation may include activating a plurality of seismic sources simultaneously or near-simultaneously.

Described herein are implementations of various techniques for a method for managing a fracturing operation. In one implementation, the method may include positioning one or more sources and one or more receivers near a hydrocarbon reservoir; pumping a fracturing fluid into a well bore of the hydrocarbon reservoir, wherein the fracturing fluid comprises an additive that enhances impedance between the fracturing fluid and one or more subsurface formations; performing a survey with the sources and the receivers during the fracturing operation; and identifying locations of the fracturing fluid within the subsurface formations in which the hydrocarbon reservoir is located.

In yet another implementation, the method may include performing a baseline electromagnetic resistivity survey before the fracturing operation; comparing the baseline electromagnetic resistivity survey to the survey performed during the fracturing operation; analyzing one or more differences between data acquired during the baseline electromagnetic resistivity survey and data acquired during the electromagnetic survey performed during the fracturing operation; and modifying the fracturing operation based on the differences.

In yet another implementation, the method may include optimizing the positioning of the sources and the receivers to illuminate one or more fracture target areas based on the identified locations of the fracturing fluid.

Described herein are implementations of various techniques for a method for managing a fracturing operation. In one implementation, the method may include positioning one or more receivers near a hydrocarbon reservoir; acquiring one or more baseline measurements using the receivers; pumping a fracturing fluid into a well bore of the hydrocarbon reservoir; acquiring one or more measurements using the receivers during the fracturing operation; comparing the baseline measurements to the measurements acquired during the fracturing operation; analyzing one or more differences between the baseline measurements to the measurements acquired during the fracturing operation; and modifying the fracturing operation based on the differences.

In yet another implementation, the measurements may include gravity measurements, gravity gradiometer measurements, magnetic measurements, geomechanical measurements, thermodynamic measurements or combinations thereof.

Described herein are also implementations of various techniques for a method for determining characteristics of a subterranean body. In one implementation, the method may include performing pressure testing in a well, wherein the pressure testing comprises drawing down pressure in the well; measuring pressure data in the well during the pressure testing; performing a survey operation; measuring survey data as part of the surveying operation; and determining the characteristics of the subterranean body based on the pressure data and the survey data.

In another implementation, the survey operation may be performed using a weight dropping system, an accelerated weight dropping system, one or more portable seismic sources or combinations thereof. In yet another implementation, the survey operation may be performed using one or more seismic sources that are activated simultaneously or near-simultaneously. In yet another implementation, the survey operation may be a seismic survey operation using one or more permanently installed receivers. In yet another implementation, the survey operation may be an electromagnetic resistivity survey using one or more electromagnetic resistivity sources and one or more electromagnetic resistivity receivers such that the survey data may be electromagnetic resistivity data.

In yet another implementation, the survey operation may be performed coincidentally with the pressure testing such that the survey data is affected by pressure changes in the subterranean body due to the pressure testing.

In yet another implementation, performing the survey operation may include performing a base survey operation prior to the pressure testing; performing a first survey operation coincidentally with the pressure testing; and comparing survey data of the base survey operation with survey data of the first survey operation. In yet another implementation, the base survey and the first survey may be performed with one or more electromagnetic sources and one or more electromagnetic receivers. In yet another implementation, the base survey and the first survey may be performed with one or more gravity receivers, one or more gravity gradiometer receivers, one or more magnetic receivers, one or more geomechanical receivers, one or more thermodynamic receivers or combinations thereof.

In yet another implementation, the method may include performing a second survey operation after the first survey operation; comparing survey data of the second survey operation with the survey data of the first survey operation; and determining the characteristics of the subterranean body based on: the comparison of the survey data of the base survey operation with the survey data of the first survey operation; and the comparison of the survey data of the second survey operations with the survey data of the first survey operation.

In yet another implementation, the method may include providing a reservoir model of the subterranean body, wherein the reservoir model is representative of the characteristics of the subterranean body; performing a simulation using the reservoir model to obtain simulated pressure data; comparing the simulated pressure data with pressure data of the pressure testing; determining an architecture of the subterranean body based on the survey data; and updating the reservoir model of the subterranean body based on the comparison and the architecture of the subterranean body. In yet another implementation, the survey data is electromagnetic resistivity data.

In yet another implementation, performing the survey operation may include performing a base survey operation prior to the pressure testing to obtain baseline data, wherein the survey data make up time-lapse data; and processing the time-lapse data to detect pressure changes. In yet another implementation, the survey operation and the base survey operation may be performed using one or more seismic sources and one or more seismic receivers, one or more electromagnetic resistivity sources and one or more electromagnetic resistivity receivers, one or more gravity receivers, one or more gravity gradiometer receivers, one or more magnetic receivers, one or more geomechanical receivers, one or more thermodynamic receivers or combinations thereof. In yet another implementation, the survey operation and the base survey operation are performed by activating one or more seismic sources simultaneously or near-simultaneously.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various technologies described herein.

DETAILED DESCRIPTION

The discussion below is directed to certain specific implementations. It is to be understood that the discussion below is only for the purpose of enabling a person with ordinary skill in the art to make and use any subject matter defined now or later by the patent "claims" found in any issued patent herein.

Active Seismic Monitoring of Fracturing Operations

This paragraph provides a brief summary of various techniques described herein. In general, various techniques described herein are directed to determining the location of fractures and fracturing fluid in formations surrounding a hydrocarbon reservoir. Rather than passively monitoring for fractures created by the fracturing operation, active seismic monitoring of fracturing operation may be used to provide stronger signaling for fracture detection. Further, pumping fracturing fluid with a high acoustic impedance contrast to the surrounding subsurface formations may increase the visibility of the fracturing fluid on the seismic survey. In one implementation, the fracturing fluid may contain an additive that provides the high acoustic impedance contrast. One or more implementations of various techniques for determining the location of fractures and fracturing fluid in formations surrounding a hydrocarbon reservoir will now be described in more detail with reference to FIGS. 1-2 in the following paragraphs.

Figure 1:
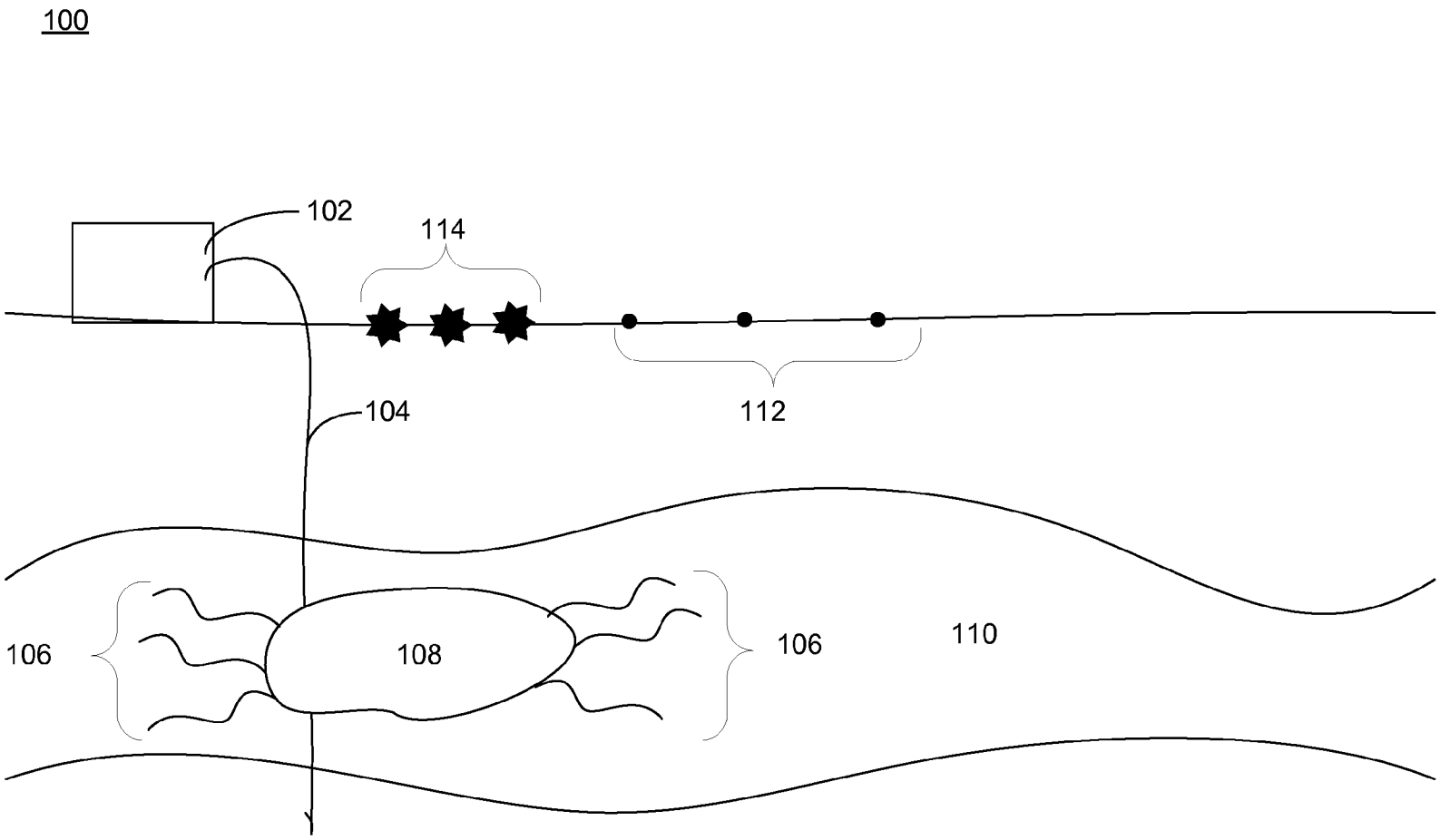
FIG. 1 illustrates a system for monitoring a hydraulic fracturing operation, in accordance with one or more implementations of various techniques described herein.

FIG. 1 illustrates a system 100 for monitoring a hydraulic fracturing operation in accordance with one or more implementations of various techniques described herein. The hydraulic fracturing operation may be also referred to herein as the fracturing operation. In the system 100, the fracturing operation may be conducted in concert with an active seismic survey in order to improve the effectiveness of the fracturing operation. The system 100 may include a pumping mechanism 102, a well bore 104, a hydrocarbon reservoir 108, a seismic receiver array 112, and a seismic source array 114.

In performing the fracturing operation, the pumping mechanism 102 may pump a fracturing fluid into the well bore 104 of the hydrocarbon reservoir 108. The hydrocarbon reservoir 108 may be disposed within a subsurface formation 110, such as a sandstone, carbonate, or chalk formation. The pressure resulting from the pumping of fracturing fluid may create fractures 106 in the formation 110. The fractures 106 may improve the flow of hydrocarbons to the well bore 104.

In a typical fracturing operation, the well bore 104 may be perforated such that the fracturing fluid enters the hydrocarbon reservoir 108 at a specified location. The location of the perforations may influence where the fractures 106 are induced in the formation.

The seismic receiver array 112 may be a standard seismic receiver array used in seismic surveying, and may include one or more geophones, receivers, or other seismic sensing equipment. The seismic receiver array 112 may be positioned on the surface, in a borehole or in a fracture. In one implementation, seismic receiver array 112 may include permanently installed receivers (i.e., reservoir monitoring system) and the like. Permanently installed receivers may include a sea bed array or surface receivers that are permanently installed in the earth. For example, permanently installed receivers may be placed in shallow boreholes and cemented therein. The seismic source array 114 may be a standard seismic source array used in seismic surveying. The seismic source array 114 may include one or more vibrators, weight dropping systems, accelerated weight dropping systems, portable sources, vibroseis, or dynamites. The seismic source array 114 may also include vibrations that occur from drilling or fracturing operations. Like the seismic receiver array 112, the seismic source array 114 may be located on the surface, in a borehole or in a fracture. The seismic source array 114 and seismic receiver array 112 may be used to perform a seismic survey during the fracturing operation.

In one implementation, the seismic survey may be used to improve the effectiveness of the fracturing operation. For example, by performing a seismic survey during the fracturing operation, it may be possible to identify where in the formation 110 the fractures 106 are induced.

Sometimes, the fractures 106 that are induced by the fracturing operation may be disposed such that the fractures 106 do not improve the flow of hydrocarbons to the well bore 104. In such a scenario, the perforations in the well bore 104 may be plugged. The well bore 104 may then be re-perforated to change the location within the hydrocarbon reservoir 108 where the fracturing fluid enters. After re-perforating the well bore 104, the fracturing operation may resume.

Although system 100 has been described with the seismic source array 114 and the seismic receiver array 112, it should be noted that in some implementations electromagnetic sources, electromagnetic receivers, gravity receivers, magnetic receivers, geomechanical receivers or thermodynamic receivers may be used in place of seismic sources and seismic receivers to monitor a hydraulic fracturing operation in accordance with one or more implementations of various techniques described herein.

Figure 2:
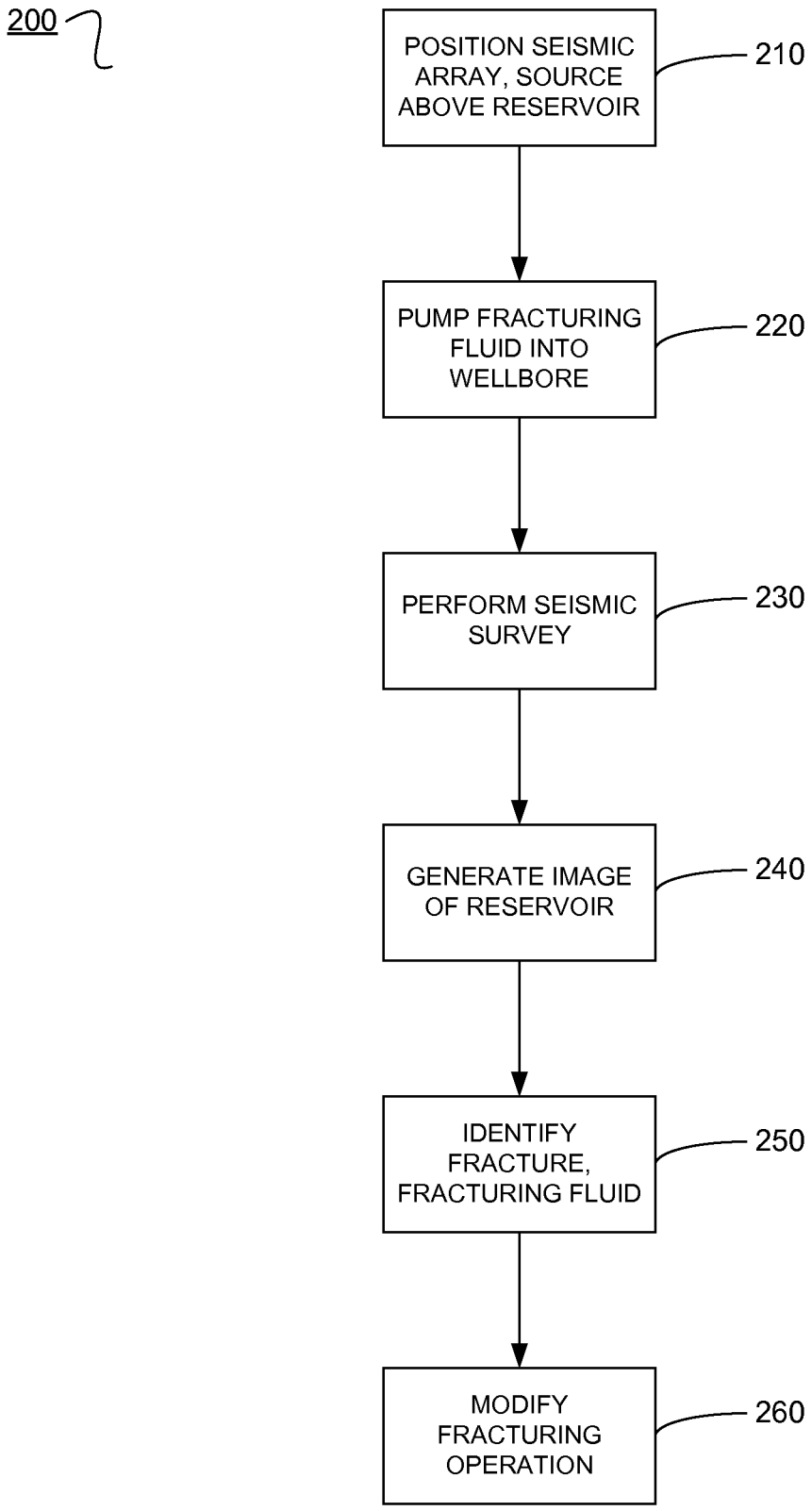
FIG. 2 illustrates a flowchart of a method for managing hydraulic fracturing operations, according to implementations described herein.

FIG. 2 illustrates a flow chart of a method 200 for managing a fracturing operation according to implementations described herein. It should be understood that while method 200 indicates a particular order of execution of the operations, in some implementations, certain portions of the operations might be executed in a different order. Further, in some implementations, additional operations or steps may be added to the method. Likewise, some operations or steps may be omitted.

At step 210, the seismic receiver array 112 and the seismic source array 114 may be positioned above the hydrocarbon reservoir 108. Surface or subsurface referenced systems may be positioned to record reflections and refractions from the fracturing fluid and the fractures that contain the fracturing fluid. This positioning can be determined through well known techniques involving seismic modeling methods, such as ray tracing or full wavefield propagation. The seismic source array 114 and seismic receiver array 112 may include devices for generating and recording pressure waves, shear waves or any combinations thereof and may encompass cabled, wireless, autonomous systems or combinations thereof.

A typical fracturing operation passively listens for acoustic signals that result from the creation of the fractures 106 induced by the fracturing operation. Because these acoustic signals may be weak, a vertical seismic profile (VSP) may be created. The VSP may be used to improve the reliability of the seismic data collected.

To create a VSP, a secondary well bore may be dug as an observational well. Seismic receivers may then be positioned in the observational well in addition to the surface receivers in the seismic receiver array 112. The acoustic signals recorded by the receivers in the observational well may then be correlated with the signals recorded at the surface.

Advantageously, using method 200, it is not necessary to dig an observational well because the seismic source array 114 is used to actively survey for fractures during the fracturing operation. The seismic source array 114 may provide a stronger signal than the signals generated in creating the fractures, such as acoustic signals generated by the breaking of rocks.

At step 220, the pumping mechanism 102 may pump fracturing fluid into the well bore of the hydrocarbon reservoir 108. As stated previously, pumping the fracturing fluid into the well bore 104 may induce fracturing of the formation 110 of the hydrocarbon reservoir 108.

At step 230, the seismic source array 114 and the seismic receiver array 112 may be used to perform the seismic survey. The pumping mechanism 102 may produce acoustic signals that introduce noise into the seismic survey. As such, the fracturing operation may be coordinated with the seismic survey such that the pumping mechanism 102 is halted while the seismic survey is being performed.

The plurality of sources in the seismic source array 114 may be activated simultaneously or near simultaneously using a simultaneous source method to perform the seismic survey. In one implementation, the simultaneous source method may include acquiring seismic survey trace data generated by the source or sources, attaching source geometry to the traces, sorting the traces according to a common feature thereof, (e.g. to CMP order), interpolating data points for discontinuities on the traces, selecting two halves or two portions slightly more than half of the traces, filtering the trace data for each of the two portions to filter out data related to a second one of the two seismic sources, reducing the filtered trace data to two halves of the data and deleting interpolated data, and then merging the two halves to produce refined useful seismic data related to a first one of the seismic sources. Additional details with regard to performing a seismic survey using a simultaneous source method may be found in U.S. Pat. No. 5,924,049. In one implementation, the simultaneously or near simultaneously activated sources may be placed in various locations such as on the surface of the earth, in a borehole, in a fracture and the like.

In one implementation, the acoustic signals produced by the pumping mechanism 102 may be used as an additional seismic source for the seismic survey. In another implementation, the pumping mechanism 102 may be used as a source in the seismic source array 114.

A baseline seismic survey may be performed before the fracturing operation. The baseline seismic survey may then be compared to the seismic survey performed during the fracturing operation to determine changes in amplitude, structural deformation and changes in rock properties, such as formation pressure, and to relate these changes to fracture fluid movement and fracture locations.

In another implementation, at step 230, electromagnetic sources and electromagnetic receivers may be used in place of seismic sources and seismic receivers to perform an electromagnetic resistivity survey of subsurface formations in the earth. An electromagnetic baseline resistivity survey may be performed before the fracturing operation and a second electromagnetic resistivity survey may be performed during the fracturing operation. The electromagnetic baseline resistivity survey may then be compared to the electromagnetic resistivity survey performed during the fracturing operation to determine changes in amplitude, structural deformation and changes in rock properties such as formation pressure. The comparison may also be used to relate these changes to fracture fluid movement and fracture locations in the subsurface of the earth.

At step 240, an image of the hydrocarbon reservoir 108 may be generated. The receivers of the seismic array 112 may record acoustic signals from the seismic source 114 during the seismic survey. Using the recorded acoustic signals, a computing system (not shown) may generate an image of the hydrocarbon reservoir 108. In the implementation where the baseline seismic survey is performed, an image may also be generated from the acoustic signals recorded during the baseline seismic survey.

At step 250, the fractures 106 and/or the fracturing fluid may be identified on the generated image. In the implementation that includes the baseline seismic survey, the fractures 106 and the fracturing fluid may be identified by analyzing differences between the image generated by the baseline seismic survey and the image generated by the seismic survey performed during the fracturing operation. Although steps 240-250 describes the fractures 106 and the fracturing fluid as being identified by analyzing the differences between images, steps 240-250 may also be performed by analyzing the differences between seismic data acquired by the seismic receivers during the baseline seismic survey and seismic data acquired by the seismic receivers during the fracturing operation. As such, the difference between the seismic data may be used to identify the fractures 106 and the fracturing fluid.

In one implementation, at steps 240-250, an image of the hydrocarbon reservoir 108 may be generated using an electromagnetic survey (e.g., conductivity of water in subsurface formations). As such, the electromagnetic receivers may record electromagnetic resistivity signals from the electromagnetic sources during the electromagnetic resistivity survey. Using the recorded resistivity signals, a computing system may generate an electromagnetic resistivity image of the hydrocarbon reservoir 108. In the implementation where the baseline electromagnetic resistivity survey is performed, an image may also be generated from the electromagnetic resistivity signals recorded during the baseline electromagnetic resistivity survey.

The fractures 106 and/or the fracturing fluid may then be identified on the electromagnetic resistivity generated image based on the electromagnetic resistivity values indicated in the image. In one implementation, the fractures 106 and the fracturing fluid may be identified by analyzing differences between the image generated by the baseline electromagnetic resistivity survey and the image generated by the electromagnetic resistivity survey performed during the fracturing operation. Although the fractures 106 and the fracturing fluid have been described as being identified by analyzing differences between the images, the fractures 106 and the fracturing fluid may also be identified by analyzing the differences between the electromagnetic resistivity data acquired by the electromagnetic receivers during the baseline electromagnetic resistivity survey and the electromagnetic resistivity data acquired by the electromagnetic receivers during the fracturing operation.

At step 260, the fracturing operation may be modified. The modification to the fracturing operation may be based on the identified fracturing fluid, the differences between the baseline image and the image obtained during the fracturing operation or the difference between the data acquired during the baseline survey and the data acquired during the fracturing operation. For example, if the identified fracturing fluid is disposed within the formation 110 such that fractures are not being produced, the fracturing operation may be modified to direct the fracturing fluid towards another location in the formation 110. In another example, if certain target areas are not being illuminated by the fracturing fluid, the positions of the sources and receivers used during a fracturing operation may be modified to optimize the illumination of the specific fracture target areas. The positions of the sources and receivers used during a fracturing operation may be modified based on the identified fracturing fluid, the differences between the baseline image and the image obtained during the fracturing operation or the difference between the data acquired during the baseline survey and the data acquired during the fracturing operation.

In one implementation, the fracturing fluid may contain an additive that enhances the acoustic impedance contrast or the electromagnetic resistivity contrast between the fracturing fluid and the formation 110 of the hydrocarbon reservoir 108. Depending on the signal to noise ratio achieved in the seismic survey, even small changes on the order of several percent can be detected. Giving the fracturing fluid a larger acoustic impedance contrast or electromagnetic resistivity contrast with the formation 110 helps to distinguish the fracturing fluid from the formation 110 in the generated image.

For example, a fracturing fluid, such as water, may not have a large acoustic impedance contrast with carbonate and chalk formations. As such, methane gas may be dissolved in the fracturing fluid, producing a fizz gas. Fizz gas may appear as bright spots in the generated image, thereby distinguishing the fracturing fluid from the formation 110.

Method 200 may also be performed using receivers that record gravity, gravity gradiometer or magnetic data. As such, gravity, gravity gradiometer or magnetic data may be used to identify fractures or fracturing fluid in subsurface formations. For instance, at step 230, a baseline survey may be performed before the fracturing operation using gravity, gravity gradiometer or magnetic data acquired by the receivers. During the fracturing operation, heavier rocks in subsurface formations may be replaced with fracturing fluids. As a result, the gravity, gravity gradiometer or magnetic data of the subsurface of the earth that correspond to the location of the fracturing operation may change. In this manner, at step 250, the fractures 106 and/or the fracturing fluid may be identified by comparing the baseline gravity, gravity gradiometer or magnetic data acquired before the fracturing operations to gravity, gravity gradiometer or magnetic data acquired during the fracturing operation.

In another implementation, method 200 may be performed using receivers that record geomechanical or thermodynamic changes in the reservoir. The geomechanical changes in the reservoir may include changes in the pressure, stress and strain of the reservoir, and the thermodynamic changes in the reservoir may include temperature changes that occur in the reservoir. As such, geomechanical or thermodynamic data may be used to identify fractures or fracturing fluid in subsurface formations. For instance, at step 230, a baseline survey may be performed before the fracturing operation using geomechanical or thermodynamic data acquired by receivers disposed above a reservoir. During the fracturing operation, the geomechanical or thermodynamic characteristics of the reservoir near the location of the fracturing operation may change due to the effects of the fracturing operation. At step 250, the fractures 106 and/or the fracturing fluid may be identified by comparing the baseline geomechanical or thermodynamic data acquired before the fracturing operations to the geomechanical or thermodynamic measurements data during the fracturing operation.

Determining Characteristics of a Subterranean Body Using Pressure Data and Seismic Data This paragraph provides a brief summary of various techniques described herein. In general, a method for determining characteristics of a subterranean body may include performing pressure testing in a well, where the pressure testing may include drawing down pressure in the well. Pressure data in the well may be measured during the pressure testing. In addition, a seismic survey operation may be performed, with seismic data received as part of the seismic surveying operation. The pressure data and seismic data may then be provided for processing to determine the characteristics of the subterranean body. One or more implementations of various techniques for determining characteristics of a subterranean body will now be described in more detail with reference to FIGS. 3-7 in the following paragraphs.

Figure 3:
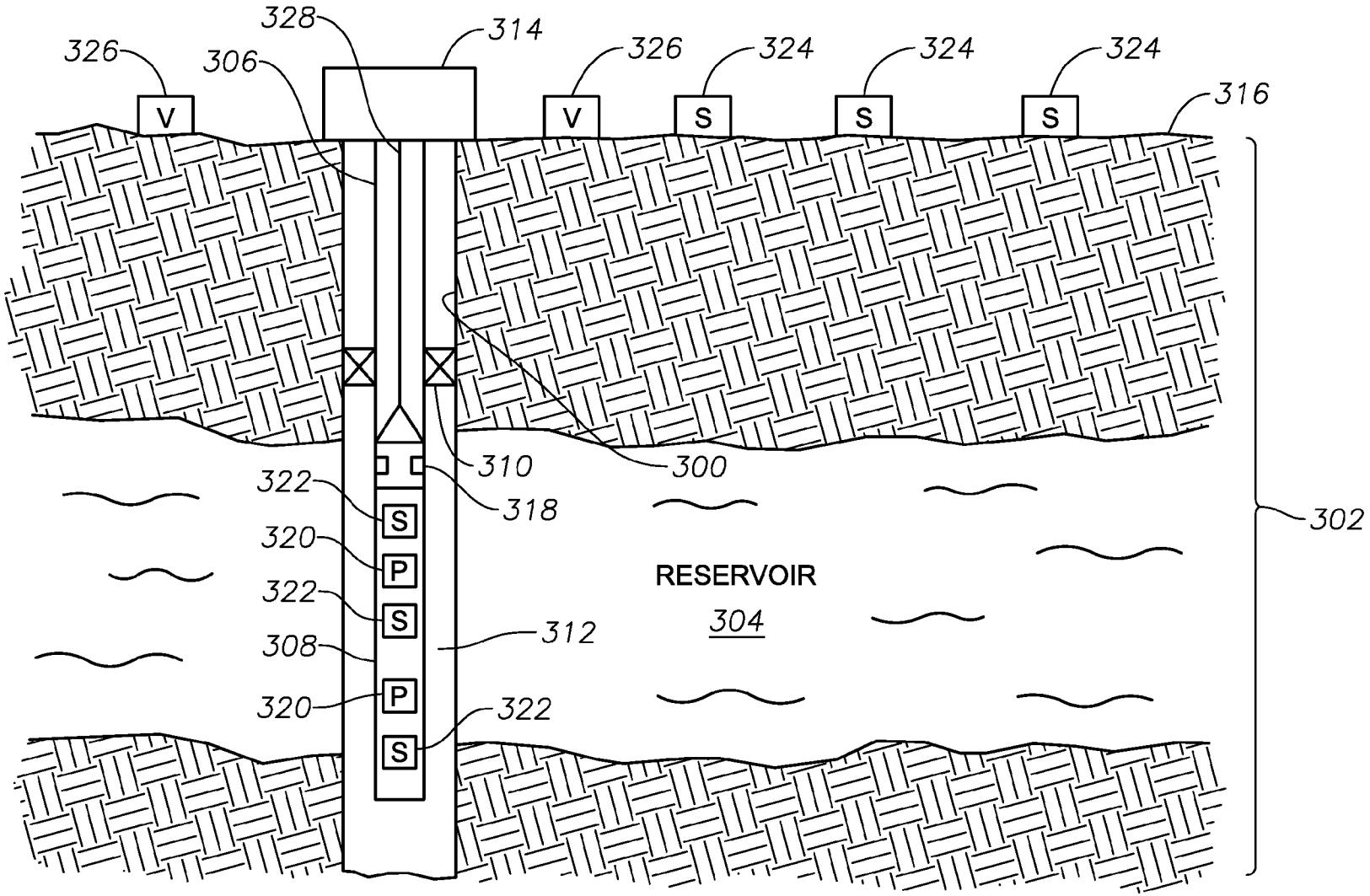
FIG. 3 illustrates an example arrangement to perform surveying of a subterranean body, in accordance with one or more implementations of various techniques described herein.

FIG. 3 illustrates an example arrangement in which a well 300 extends through a formation 302. A reservoir 304 is located in the formation 302, where the reservoir 304 can be a hydrocarbon-bearing reservoir, a water aquifer, a gas injection zone, or any other type of a subterranean body. The well 300 also extends through a portion of the reservoir 304.

In the implementation of FIG. 3, a tool string is positioned in the well 300, where the tool string includes a tubing 306 and a monitoring tool 308 attached to the tubing 306. The tubing 306 can be coiled tubing, jointed tubing, and so forth. As also depicted in FIG. 3, a packer 310 is set around the outside of the tubing 306. When set, the packer 310 isolates a well region 312 underneath the packer 310.

The tubing 306 extends to wellhead equipment 314 at an earth surface 316. Note that the earth surface 316 can be a land surface, or alternatively, can be a sea floor in a marine environment.

The tool string depicted in FIG. 3 has the ability to perform well testing (including pressure testing) in the well region 312 underneath the packer 310. In one example, ports 318 can be provided in the tool string to allow for fluid flow from the well region 312 into an inner bore of the tubing 306. This can allow for a pressure drawdown to be provided during a pressure-testing operation. Drawing down pressure refers to creating a pressure drop in the well region 312, where the pressure drop can cause the pressure in the well region 312 to fall below the reservoir 304 pressure.

The monitoring tool 308 of the tool string includes pressure sensors 320. Although multiple pressure sensors 320 are depicted, note that in an alternative implementation, just one pressure sensor can be used. The pressure sensors 320 are used to measure pressure data during the pressure testing operation.

In accordance with some implementations, pressure data collected by the pressure sensors 320 can be stored in the tool string, such as in one or more storage devices in the tool string. Alternatively, the measurement data collected by the pressure sensors 320 can be communicated over a communications link 328 to wellhead equipment 314 or other surface equipment.

In addition to pressure sensors 320, the tool string can also include other types of sensors, such as sensors to measure temperature, fluid type, flow rate, permeability, and so forth. Such other measurement data, which can be collected during the well testing, can also be stored in storage devices of the tool string or communicated to the surface over the communications link 328.

In the example of FIG. 3, the monitoring tool 308 can also optionally include seismic sensors 322. In a different implementation, the seismic sensors 322 that are part of the tool string can be omitted. In such an implementation, seismic sensors 324 can be provided at the earth surface 316 instead. As yet another alternative, both seismic sensors 322 in the well 300 and seismic sensors 324 in the earth surface 316 can be provided. The seismic sensors 322, 324 can be any one or more of geophones, hydrophones, accelerometers, etc. The seismic sensors 322, 324 may also include permanently installed receivers (i.e., reservoir monitoring system) and the like. Permanently installed receivers may include a sea bed array or surface receivers that are permanently installed in the earth. For example, permanently installed receivers may be placed in shallow boreholes and cemented therein.

The seismic sensors 322 in the well 300 allow for performance of vertical seismic profile (VSP) surveying. Alternatively, the seismic sensors 324 at the earth surface 316 provide for surface seismic surveying. In some implementations, the measurements taken by the downhole sensors 322 can be used to calibrate the surface sensors 324 for the purpose of determining reservoir characteristics.

Seismic waves are generated by seismic sources 326, which can be deployed at the earth surface 316, or alternatively, can be deployed in the well 300. As yet another implementation, the seismic sources 326 can be towed in a body of water in a marine seismic surveying context. Examples of seismic sources include air guns, vibrators, explosives, or other sources that generate seismic waves. The seismic sources 326 may also include one or more vibrators, weight dropping systems, accelerated weight dropping systems, portable sources, vibroseis, or dynamites. The seismic waves generated by a seismic source travel through a formation, with a portion of the seismic waves reflected back by structures within the formation, such as the reservoir 304. The reflected seismic waves are received by seismic sensors. Reflected seismic signals detected by the seismic sensors are stored as seismic measurement data.

In the implementation where seismic sensors 322 are provided as part of the monitoring tool 308, seismic data can be stored in storage devices of the tool string or communicated over the communications link 328 to the surface.

The collected seismic data and pressure data can be processed by a processing system (e.g., a computer). Processing of the pressure data and seismic data can include any one or more of the following: interpreting the pressure data and seismic data together to determine characteristics of the reservoir 304; inverting the pressure data and seismic data to identify characteristics of the reservoir 304; and so forth.

Although FIG. 3 has been described with seismic sources 326, seismic sensors 322, seismic sensors 324, it should be noted that in some implementations electromagnetic sources, electromagnetic receivers, gravity receivers, magnetic receivers, geomechanical receivers or thermodynamic receivers may be used in place of seismic sources and seismic sensors to monitor various changes in the reservoir.

Figure 4:
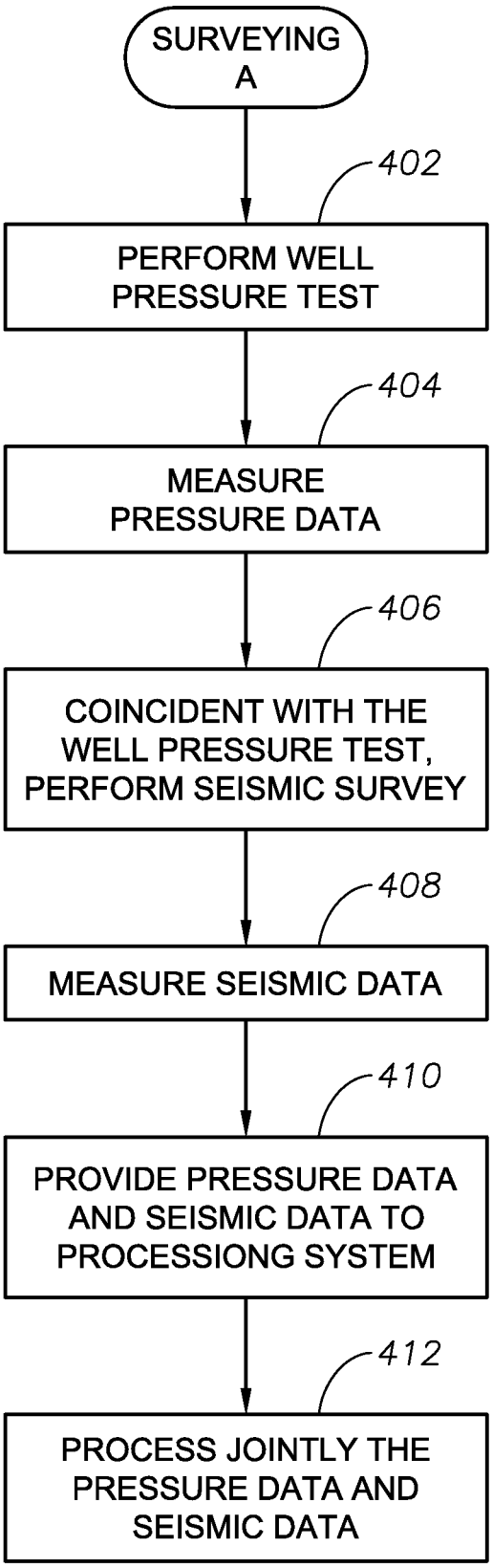
FIGS. 4 and 5 illustrate flow diagrams of processes of performing surveying using seismic data and pressure data, according to implementations described herein.

FIG. 4 illustrates a flow diagram of a surveying operation for determining characteristics of a reservoir or other subterranean body in accordance with implementations described herein. A well pressure test is performed (at 402), where the well pressure test involves drawing down pressure in a well region (e.g., well region 312 in FIG. 3). The well pressure test that includes drawing down the pressure in the well region 312 causes a pressure drop between the reservoir 304 and the well region 312. As part of the well pressure test, the well is shut in (in other words, sealed at the earth surface or at some other location in the well) such that no further fluid communication occurs between the well 300 and the earth surface location. After shut in, the pressure in the well region 312 builds up gradually as a result of fluid flow from the reservoir 304 into the well region 312. During this time, the pressure sensors 320 can make (at 404) measurements at different time points to obtain a record of the pressure change behavior during the well pressure test. In addition to pressure data, other sensors can make measurements of other parameters (e.g., temperature, fluid type, flow rate, permeability, etc.).

Based on the pressure data obtained as part of the well pressure test, it can be determined how far from the well 300 the reservoir extends. In other words, a characteristic of the reservoir 304 that can be determined using the well pressure test is a radial extent of the reservoir from the well.

However, as noted above, determining characteristics of a reservoir based on just well pressure testing does not produce comprehensive information. In accordance with some implementations, seismic surveying is also performed (at 406) coincident with the well pressure test. Performing seismic surveying "coincident" with the well pressure test refers to either simultaneously performing the well pressure test and seismic survey together at about the same time, or alternatively performing the seismic surveying a short time after the well pressure test. Changes in reservoir pressure have an effect on the rock matrix and fluids in the reservoir. Seismic data is sensitive to such pressure changes.

As part of the seismic surveying operation, seismic data is measured (at 408) by seismic sensors (e.g., seismic sensors 322 in the well 300 or seismic sensors 324 on the surface 316). Performing the seismic surveying involves activating seismic sources 326 to produce seismic waves that are reflected from the reservoir 304. In one implementation, performing the seismic surveying involves activating seismic sources 326 simultaneously or near simultaneously using a simultaneous source method as described above in paragraph [0053]. The reflected seismic waves are detected by the seismic sensors 322 and/or 324.

Next, the pressure data and seismic data are provided (at 410) to a processing system for subsequent processing. The pressure data and seismic data are then processed (at 412) jointly by the processing system. Processing the pressure data and seismic data jointly (or together) refers to determining characteristics of the reservoir 304 based on both the pressure data and seismic data.

Based on the pressure data and seismic data, various characteristics of the reservoir 304 can be ascertained, including the presence of any flow barriers inside the reservoir 304.

Note that additional information that can be considered by the processing system in determining characteristics of the reservoir 304 includes information relating to temperature, fluid types (types of fluid in the reservoir), flow rates (rate of flow of fluids), permeability, and other information.

As a result of the seismic surveying, pressure differentials across flow barriers of the reservoir can be determined. Using p-wave velocity and/or s-wave velocity information, a pressure profile can be determined. This pressure profile can be used to identify the differential pressures in the reservoir 304 such that spatial locations of flow barriers can be identified.

Seismic surveying can refer to any type of seismic surveying, such as marine, land, multi-component, passive seismic, earth body wave seismic, and so forth.

Although steps 406, 408, 410 and 412 have been described using seismic data acquired by seismic sources and seismic receivers, in some implementations these steps may be performed using electromagnetic resistivity data acquired by electromagnetic sources and electromagnetic receivers.

Figure 5:
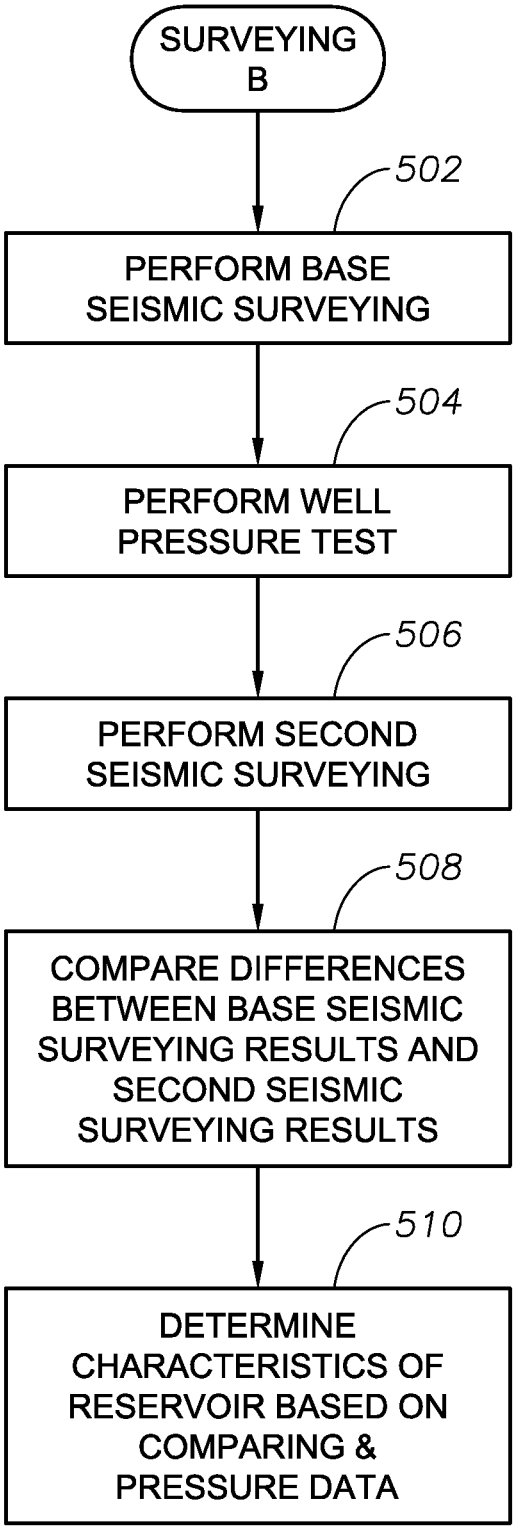

FIG. 5 illustrates a flow diagram of a surveying operation according to another implementation. Here, a base seismic surveying is performed (at 502) prior to performing well pressure testing. As a result of the base seismic surveying, base seismic data is recorded (this is the baseline measurement data).

Then, a well pressure test is performed (at 504), similar to the well pressure test at 402 in FIG. 4. As a result of the well pressure test, pressure data is measured. Coincident with the well pressure test, a second seismic surveying operation is performed (at 506). Seismic data resulting from the second seismic survey operation is recorded (this is the monitor measurement data).

Note that the second seismic surveying operation is affected by the well pressure test that involves a drawdown of pressure in the well. In contrast, the seismic data recorded from the base seismic surveying operation is not affected by the pressure drawdown performed in the well pressure testing. Therefore, the seismic data of the second seismic surveying operation would be different from the seismic data of the base seismic surveying operation.

The seismic data (of both the base and second seismic surveying operations) and pressure data are provided to a processing system, which compares (at 508) the differences between the base seismic surveying seismic data and second seismic surveying seismic data. The differences in amplitudes of p-waves, for example, can be related to pressure changes that identify locations of flow barriers. Based on the comparison results, and the pressure data, characteristics of the reservoir can be determined (at 510).

Alternatively, additional monitor seismic survey operations can be performed over time after the base seismic survey operation. The differential changes between respective seismic data of the monitor seismic survey operations can be used to determine pressure changes, which can then be used to determine reservoir characteristics.

In one implementation, the base seismic surveying performed at step 502 and the second seismic surveying performed at step 506 may be performed by activating seismic sources 326 simultaneously or near simultaneously using a simultaneous source method to perform the seismic surveys as described above in paragraph [0053].

Although steps 502, 506, 508 and 510 have been described using seismic data acquired by seismic sources and seismic receivers, in some implementations these steps may be performed using electromagnetic resistivity data acquired by electromagnetic sources and electromagnetic receivers. In yet another implementation, steps 502-510 described above may also be performed using receivers that record gravity, gravity gradiometer or magnetic data, as opposed to seismic sensors 322/324. In this manner, at step 502, base gravity, gravity gradiometer or magnetic data may be acquired prior to performing the well pressure test. At step 506, gravity, gravity gradiometer or magnetic data may be acquired coincident with the well pressure test. As such, the acquired gravity, gravity gradiometer or magnetic measurements may measure the changes in the gravity, gravity gradiometer or magnetic characteristics of the reservoir due to the well pressure test.

The gravity, gravity gradiometer or magnetic data (of both the base and coincident operations) and pressure data are then provided to a processing system, which compares (at step 508) the differences between the base gravity, gravity gradiometer or magnetic data and the coincident gravity, gravity gradiometer or magnetic data. The differences between the base gravity, gravity gradiometer or magnetic data and the coincident gravity, gravity gradiometer or magnetic data may be used to determine characteristics of the reservoir (at step 510).

Additional gravity, gravity gradiometer or magnetic data can be acquired over time after the base gravity, gravity gradiometer or magnetic data has been acquired. The differential changes between later gravity, gravity gradiometer or magnetic data acquisitions can be used to determine pressure changes and reservoir characteristics.

In still another implementation, steps 502-510 described above may also be performed using geomechanical or thermodynamic receivers, as opposed to seismic sensors 322/324. In this manner, at step 502, base geomechanical or thermodynamic data may be acquired prior to performing the well pressure test. At step 506, geomechanical or thermodynamic data may be acquired coincident with the well pressure test. As such, the acquired geomechanical or thermodynamic data may measure the changes in the geomechanical or thermodynamic characteristics of the reservoir due to the well pressure test.

The geomechanical or thermodynamic data (of both the base and coincident operations) and pressure data are then provided to a processing system, which compares (at step 508) the differences between the base geomechanical or thermodynamic data and the coincident geomechanical or thermodynamic data. The differences between the base geomechanical or thermodynamic data and the coincident geomechanical or thermodynamic data may be used to determine characteristics of the reservoir (at step 510).

Additional geomechanical or thermodynamic data can be acquired over time after the base geomechanical or thermodynamic data has been acquired. The differential changes between later geomechanical or thermodynamic data acquisitions can be used to determine pressure changes and reservoir characteristics.

Figure 6:
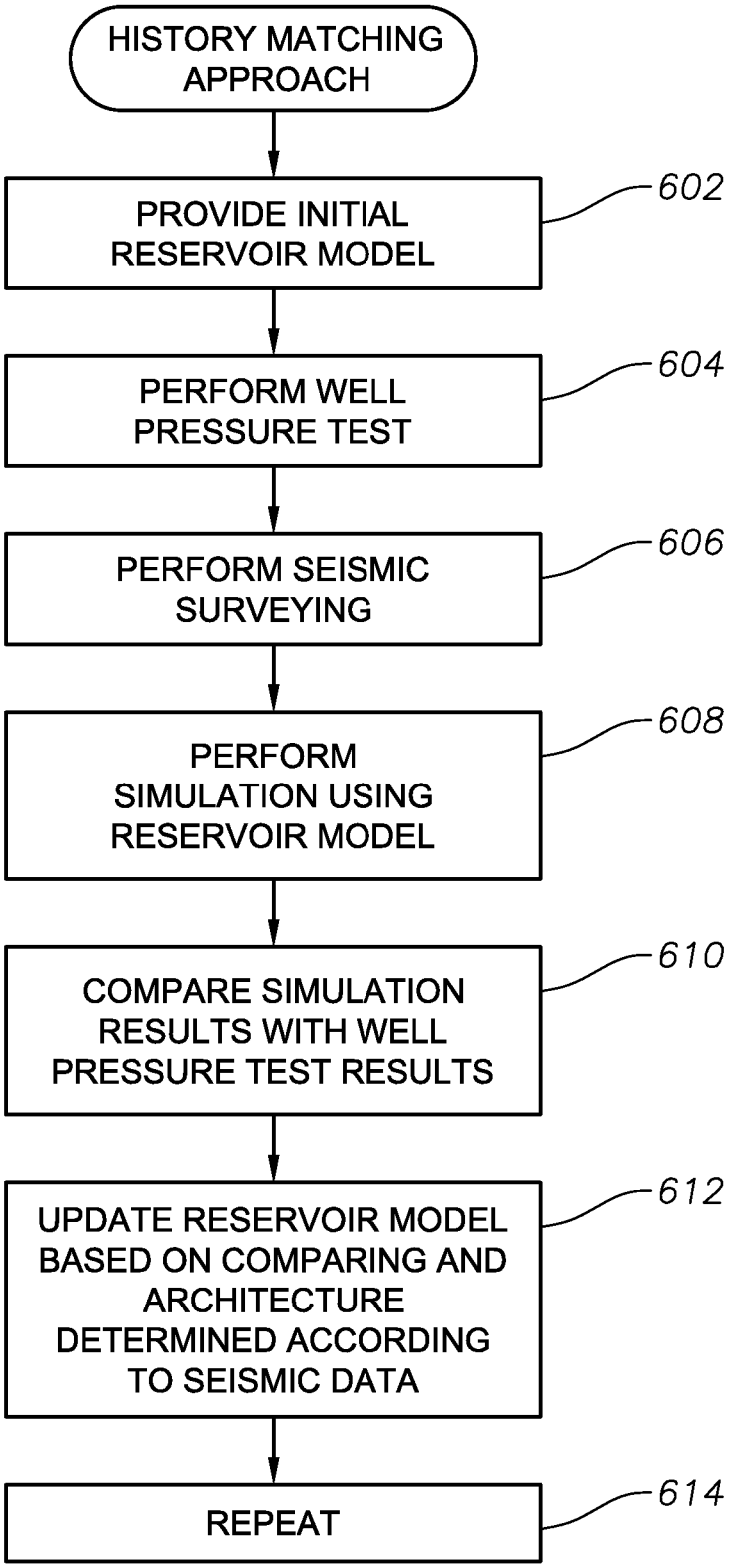
FIG. 6 illustrates a flow diagram of a process of using a history matching approach to characterize a subterranean body, according to implementations described herein.

Various interpretive techniques of characterizing a subterranean body have been described herein. In one implementation, a history-matching approach can be used, as depicted in FIG. 6. In this approach, an initial reservoir model is initially provided (at 602). This initial reservoir model can be a homogeneous, three-dimensional (3D) model of a subterranean model, which assumes that the reservoir is homogeneous. Note that such assumption is generally not true, and thus the initial model may not be completely accurate.

At step 604, a well pressure test is performed, with pressure data collected as a result of the well pressure test. At step 606, seismic surveying can be performed.

At step 608, a simulation is then performed using the reservoir model, which at this point is the initial reservoir model. The simulation models the pressure drawdown as a function of time. The simulation results are compared (at 610) with the well pressure results to determine the level of matching. Initially, it is unlikely that the simulation results will match with the well pressure test results. Consequently, the reservoir model is updated (at 612) based on the comparison and on architecture or structural information of the reservoir that is determined according to the seismic data. The seismic data allows a well operator to determine the structure or architecture of the reservoir. This determined structure or architecture, in conjunction with the comparison of the simulated pressure data and actual pressure data, can then be used to update the reservoir model such that a more accurate reservoir model is provided. The process at 604-612 is then repeated (at 614) using the updated reservoir model. The tasks are iteratively performed to incrementally update the reservoir model until the comparison performed at 610 indicates a match between the simulated pressure data and the actual pressure data within some predefined threshold.

Note that instead of using seismic data based on performing seismic surveying (at 606), tilt meter information can be collected instead for determining the structure or architecture of the reservoir. Alternatively, both seismic data and tilt meter data can be used.

Although the seismic survey performed at step 606 is performed with seismic sources 326 and seismic receivers 322, 324, in other implementations an electromagnetic resistivity survey may be performed at step 606 instead of a seismic survey. In this case, at step 612, the reservoir model may be updated based on the comparison between the well pressure results and the simulation results performed at step 610 and also based on architecture or structural information of the reservoir that is determined according to the electromagnetic resistivity data.

Figure 7:
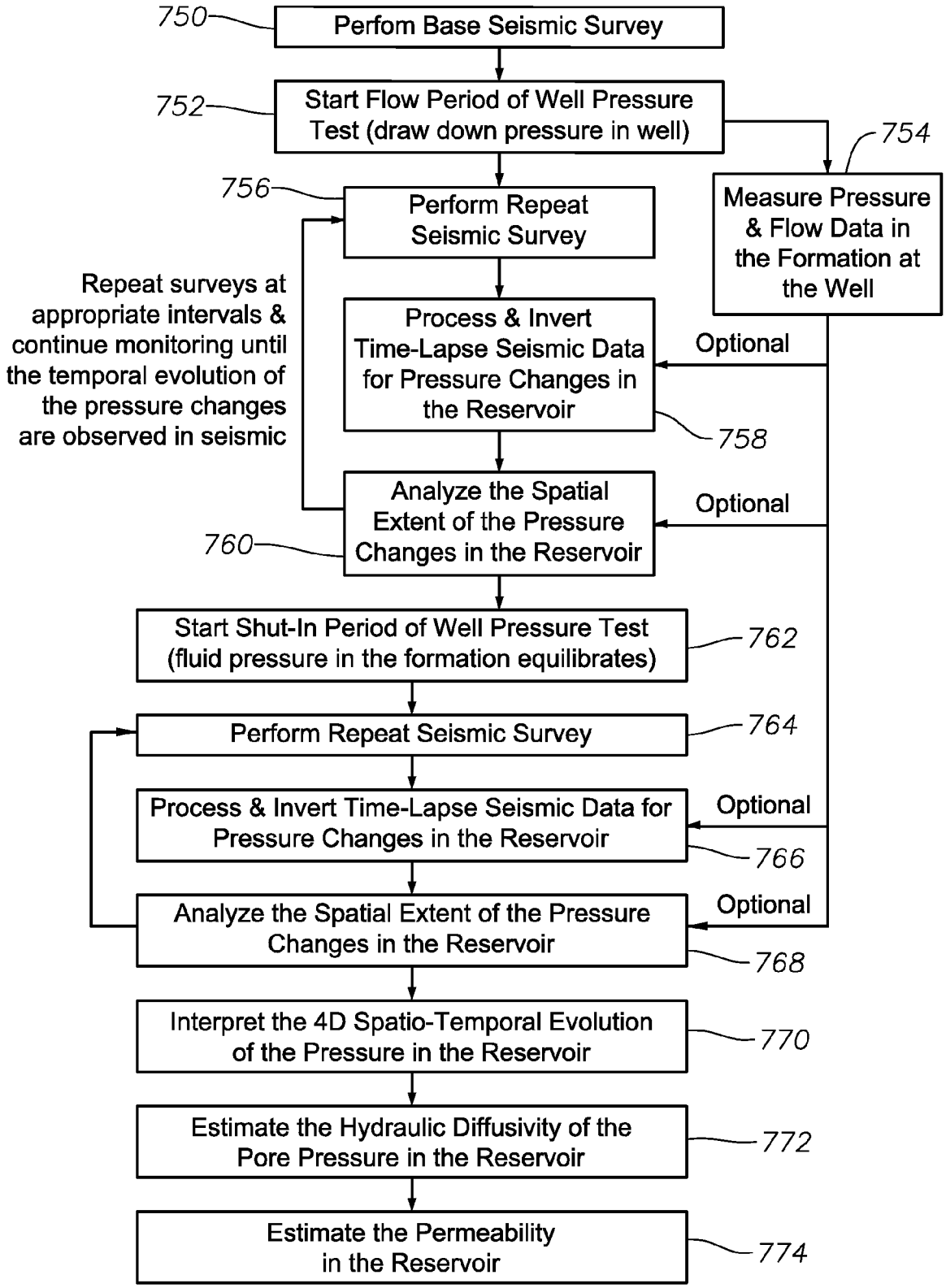
FIG. 7 illustrates a flow diagram of a process of performing surveying using seismic data and pressure data, according to implementations described herein.

FIG. 7 shows yet another implementation of a surveying operation that uses both seismic and pressure data. Initially, a base seismic survey is performed (at 750), prior to performing well pressure testing. This provides the baseline seismic data.

Next, a well pressure test is started (at 752), in which fluid flow is created by drawing down pressure in the well. Pressure and fluid flow data associated with the formation and well are measured (at 754).

A seismic survey is then repeated (at 756) to collect seismic data after the pressure drawdown. The point here is to keep repeating the seismic surveys at periodic intervals and continue monitoring until the temporal evolution of the pressure changes are observed in the seismic data.

The time-lapse seismic data (seismic data collected at different times in different surveys) are processed and inverted (at 758) to detect pressure changes in the reservoir. Also, the spatial extent of the pressure changes in the reservoir can be analyzed (at 760). Note that the "optional" label to boxes 758 and 760 means that the measured pressure data (which is continually occurring) can be provided as optional inputs to perform the tasks of boxes 758 and 760.

If additional data is desired, the well can be shut in (at 762). As a result of shut-in, the fluid pressure in the formation equilibrates. Another seismic survey is performed (at 764) after shut in. Again, the time-lapse seismic data can be processed and inverted (at 766) to detect pressure changes in the reservoir. Also, the spatial extent of the pressure changes in the reservoir can be analyzed (at 768).

Note that tasks 762-768 are optional and can be omitted if the additional data is not desired by the survey operator.

The four-dimensional (4D) spatio-temporal evolution of the pressure in the reservoir can then be determined (at 770). What this means is that movement of pressure fronts as a function of both time and space can be captured.

The hydraulic diffusivity of the pore pressure in the reservoir can be estimated (at 772). Also, determining the 4D spatio-temporal evolution of the pressure in the reservoir allows changes in the elastic properties of the formation rock to be monitored during well tests so as to estimate permeability (at 774) from the spatio-temporal analysis of the pressure-induced elastic changes.

In one implementation, the seismic surveying performed at steps 606, 750 and 756 may be performed by activating seismic sources 426 simultaneously or near simultaneously using a simultaneous source method as described above in paragraph Although the seismic survey performed at steps 750 and 756 are performed with seismic sources 326 and seismic receivers 322, 324, in other implementations an electromagnetic resistivity survey may be performed at steps 750 and 756 instead of a seismic survey.

In yet another implementation, gravity, gravity gradiometer, magnetic, geomechanical or thermodynamic data may be acquired at steps 750 and 756 such that the time lapse data may be processed and inverted (at steps 758 and 766) to detect pressure changes in the reservoir (at steps 760 and 768).

Figure 8:
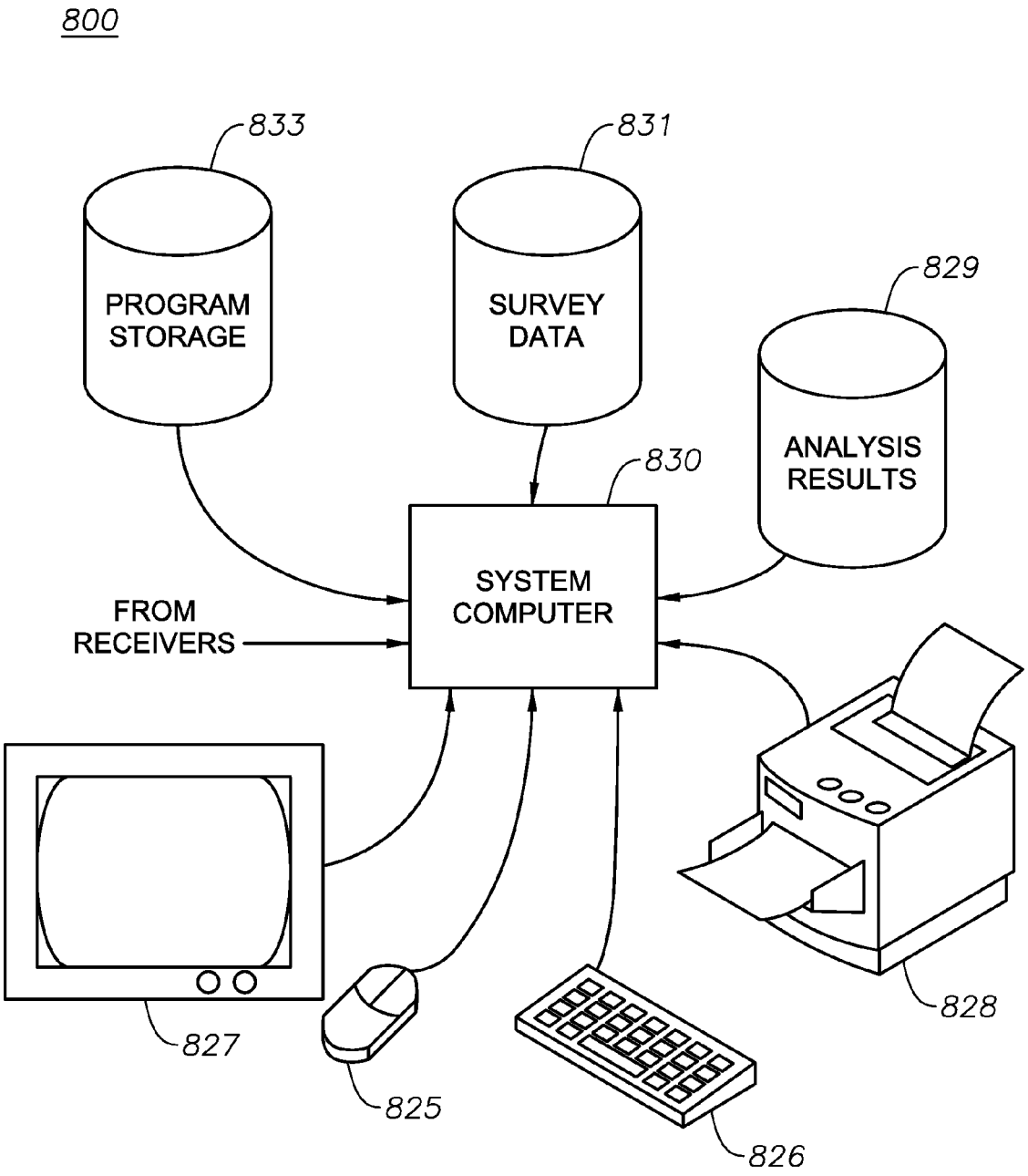
FIG. 8 illustrates a computer network, into which implementations of various technologies described herein may be implemented.

FIG. 8 illustrates a computing system 800, into which implementations of various technologies described herein may be implemented. The computing system 800 may include one or more system computers 830, which may be implemented as any conventional personal computer or server. However, those skilled in the art will appreciate that implementations of various technologies described herein may be practiced in other computer system configurations, including hypertext transfer protocol (HTTP) servers, handheld devices, multiprocessor systems, microprocessor-based or programmable consumer electronics, network PCs, minicomputers, mainframe computers, and the like.

The system computer 830 may be in communication with disk storage devices 829, 831, and 833, which may be external hard disk storage devices. It is contemplated that disk storage devices 829, 831, and 833 are conventional hard disk drives, and as such, will be implemented by way of a local area network or by remote access. Of course, while disk storage devices 829, 831, and 833 are illustrated as separate devices, a single disk storage device may be used to store any and all of the program instructions, measurement data, and results as desired. In one implementation, disk storage devices 829, 831, and 833 may contain various data such as pressure data, seismic data, tilt meter data, a reservoir model and the like.

In one implementation, seismic data from the receivers may be stored in disk storage device 831. The system computer 830 may retrieve the seismic data from the disk storage device 831 such that the seismic data may be processed according to program instructions that correspond to implementations of various technologies described herein. The program instructions may be written in a computer programming language, such as C++, Java and the like. The program instructions may be stored in a computer-readable medium, such as program disk storage device 833. Such computer-readable media may include computer storage media and communication media. Computer storage media may include volatile and non-volatile, and removable and non-removable media implemented in any method or technology for storage of information, such as computer-readable instructions, data structures, program modules or other data. Computer storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium which can be used to store the desired information and which can be accessed by the system computer 830. Although disk storage device 831 has been described as storing seismic data from receivers, in other implementations, any type of data received from any type of receivers such as electromagnetic receivers, gravity receivers, gravity gradiometer receivers, magnetic receivers, geomechanical receivers, thermodynamic receivers and the like may be stored in disk storage device 831. The system computer 830 may then retrieve the data from the disk storage device 831 such that the data may be processed according to program instructions that correspond to various technologies described herein.

Communication media may embody computer readable instructions, data structures, program modules or other data in a modulated data signal, such as a carrier wave or other transport mechanism and may include any information delivery media. The term "modulated data signal" may mean a signal that has one or more of its characteristics set or changed in such a manner as to encode information in the signal. By way of example, and not limitation, communication media may include wired media such as a wired network or direct-wired connection, and wireless media such as acoustic, RF, infrared and other wireless media. Combinations of any of the above may also be included within the scope of computer readable media.

In one implementation, the system computer 830 may present output primarily onto graphics display 827, or alternatively via printer 828. The system computer 830 may store the results of the methods described above on disk storage 829, for later use and further analysis. The keyboard 826 and the pointing device (e.g., a mouse, trackball, or the like) 825 may be provided with the system computer 830 to enable interactive operation.

The system computer 830 may be located at a data center remote from the survey region. The system computer 830 may be in communication with the receivers (either directly or via a recording unit, not shown), to receive signals indicative of the reflected seismic energy. These signals, after conventional formatting and other initial processing, may be stored by the system computer 830 as digital data in the disk storage 831 for subsequent retrieval and processing in the manner described above. While FIG. 8 illustrates the disk storage 831 as directly connected to the system computer 830, it is also contemplated that the disk storage device 831 may be accessible through a local area network or by remote access. Furthermore, while disk storage devices 829, 831 are illustrated as separate devices for storing input seismic data and analysis results, the disk storage devices 829, 831 may be implemented within a single disk drive (either together with or separately from program disk storage device 833), or in any other conventional manner as will be fully understood by one of skill in the art having reference to this specification.

While certain implementations have been disclosed in the context of seismic data collection and processing, those with skill in the art will recognize that the disclosed methods can be applied in many fields and contexts where data representing reflections are collected and processed, e.g., medical imaging techniques such as tomography, ultrasound, MRI and the like, SONAR techniques and the like.

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for managing a fracturing operation, comprising:

positioning one or more sources and one or more receivers near a hydrocarbon reservoir;

performing a baseline survey;

pumping a fracturing fluid into a well bore of the hydrocarbon reservoir;

performing a survey with the sources and the receivers during the fracturing operation;

comparing the baseline survey to the survey performed during the fracturing operation;

analyzing one or more differences between the baseline survey and the survey performed during the fracturing operation; and modifying the fracturing operation based on the differences.

2. The method of claim 1, further comprising identifying locations of the fracturing fluid within subsurface formations in which the hydrocarbon reservoir is located based on the survey.

3. The method of claim 2, further comprising modifying the fracturing operation based on the identified locations of the fracturing fluid.

4. The method of claim 1, further comprising modifying the positioning of the sources, the receivers or combinations thereof based on the differences.

5. The method of claim 1, further comprising generating a survey design based on the differences.

6. The method of claim 1, wherein the sources comprise a weight dropping system, an accelerated weight dropping system, portable sources or combinations thereof.

7. The method of claim 1, wherein the sources comprise one or more vibrations from a drilling operation or a fracturing operation.

8. The method of claim 1, wherein the receivers are permanently installed receivers.

9. The method of claim 1, wherein the sources are located on a surface, in a borehole, in a fracture or combinations thereof.

10. The method of claim 1, wherein the receivers are located on a surface, in a borehole, in a fracture or combinations thereof.

11. The method of claim 1, wherein the sources are electromagnetic sources and the receivers are electromagnetic receivers.

12. The method of claim 1, wherein the sources are seismic sources and the receivers are seismic receivers.

13. The method of claim 12, wherein the baseline survey or the survey performed during the fracturing operation comprises activating a plurality of the seismic sources simultaneously or near-simultaneously.

14. A method for managing a fracturing operation, comprising:

positioning one or more sources and one or more receivers near a hydrocarbon reservoir;

pumping a fracturing fluid into a well bore of the hydrocarbon reservoir, wherein the fracturing fluid comprises an additive that enhances impedance contrast between the fracturing fluid and one or more subsurface formations;

performing a survey with the sources and the receivers during the fracturing operation; and identifying locations of the fracturing fluid within the subsurface formations in which the hydrocarbon reservoir is located.

15. The method of claim 14, wherein the sources comprise a weight dropping system, an accelerated weight dropping system, portable sources or combinations thereof.

16. The method of claim 14, wherein the receivers are permanently installed receivers.

17. The method of claim 14, wherein the sources are electromagnetic sources and the receivers are electromagnetic receivers.

18. The method of claim 15, further comprising:

performing a baseline electromagnetic resistivity survey before the fracturing operation;

comparing the baseline electromagnetic resistivity survey to the survey performed during the fracturing operation;

analyzing one or more differences between data acquired during the baseline electromagnetic resistivity survey and data acquired during the electromagnetic survey performed during the fracturing operation; and modifying the fracturing operation based on the differences.

19. The method of claim 14, further comprising modifying the positioning of the sources, the receivers or combinations thereof based on the identified locations of the fracturing fluid.

20. The method of claim 14, further comprising optimizing the positioning of the sources and the receivers to illuminate one or more fracture target areas based on the identified locations of the fracturing fluid.

21. The method of claim 14, wherein the sources are activated simultaneously or near-simultaneously.

22. A method for managing a fracturing operation, comprising:

positioning one or more receivers near a hydrocarbon reservoir;

acquiring one or more baseline measurements using the receivers;

pumping a fracturing fluid into a well bore of the hydrocarbon reservoir;

acquiring one or more measurements using the receivers during the fracturing operation;

comparing the baseline measurements to the measurements acquired during the fracturing operation;

analyzing one or more differences between the baseline measurements to the measurements acquired during the fracturing operation; and modifying the fracturing operation based on the differences.

23. The method of claim 22, wherein the measurements comprise gravity measurements, gravity gradiometer measurements, magnetic measurements, geomechanical measurements, thermodynamic measurements or combinations thereof.

* * * * *